US006161302A

United States Patent [19]

Rantala

[11] Patent Number: 6,161,302

[45] Date of Patent: Dec. 19, 2000

[54] DRYER APPARATUS FOR FIBER WEBS

[76] Inventor: Pekka Rantala, Dosentintie 2, FIN-02700 Kauniainen, Finland

[21] Appl. No.: 09/125,286

[22] PCT Filed: Feb. 14, 1997

[86] PCT No.: PCT/FI97/00092

§ 371 Date: Aug. 14, 1998

§ 102(e) Date: Aug. 14, 1998

[87] PCT Pub. No.: WO97/30214

PCT Pub. Date: Aug. 21, 1997

[30] Foreign Application Priority Data

Feb. 16, 1996 [FI] Finland ..... 960702

[51] Int. Cl.[7] ..... F26B 11/02

[52] U.S. Cl. ..... 34/119; 34/124; 34/128; 34/134; 165/89; 165/90; 165/91

[58] Field of Search ..... 34/108, 109–114, 34/115, 119, 122, 124, 125, 128, 134, 595, 603, 179; 165/20, 21, 89

[56] References Cited

U.S. PATENT DOCUMENTS

| | | | |
|---|---|---|---|
| 3,419,068 | 12/1968 | Grierson . | |
| 3,581,812 | 6/1971 | Fleissner et al. | 165/89 |
| 3,808,700 | 5/1974 | Kraus | 34/124 |
| 3,838,734 | 10/1974 | Kilmartin | 165/90 |
| 3,903,961 | 9/1975 | Stanislaw | 165/89 |
| 4,252,184 | 2/1981 | Appel . | |
| 4,717,338 | 1/1988 | Cellier | 432/60 |
| 4,780,967 | 11/1988 | Mucic | 34/86 |
| 4,889,048 | 12/1989 | Miller | 100/93 |
| 5,054,543 | 10/1991 | Thomas et al. | 165/89 |
| 5,456,025 | 10/1995 | Joiner et al. | 34/528 |
| 5,590,704 | 1/1997 | Eriksen et al. | 165/90 |
| 5,899,264 | 5/1999 | Marschke | 165/89 |

*Primary Examiner*—Pamela Wilson
*Assistant Examiner*—Michelle A. Mattera
*Attorney, Agent, or Firm*—Blank Rome Comisky & McCauley LLP

[57] ABSTRACT

The invention relates to a dryer apparatus for fiber webs (10), such as webs of natural fiber, synthetic fiber and the like. The apparatus comprises a rotating dryer cylinder (1), the interior of which is provided with elements (8) for injecting hot heat-transfer fluid against the inner cylinder surface and for discharging if from the cylinder interior. The invention relates also to a method for heating a cylinder by injecting hot heat-transfer fluid against the inner surface of the heating cylinder.

11 Claims, 2 Drawing Sheets

DRYER APPARATUS FOR FIBER WEBS

BACKGROUND OF THE INVENTION

The present invention relates to a dryer apparatus for paper, cardboard or some other porous fiber web. The invention replaces the pressurized-steam heated cast-iron dryer cylinders available since the nineteenth century.

Development in the art of paper making machines has been slow and concentrated mainly on the so-called wet end. An object of the machine is to dewater pulp pumped onto the machine and formed into an even fiber web. As for a newsprint machine, for example, the dewatering breaks up as follows:

the wire section 98.8%, by suction and gravitation
the press section 0.6%, by pressing
the dryer section 0.6%, by steam-heated cylinders.

The dryer section constitutes about 80% of the total machine weight and also represents technology from decades ago.

The dryer section of a paper machine, e.g. in the production of cardboard and newsprint, comprises 45–65 cast-iron cylinders, diameter 1.5–1.8 meters, fast rotating (peripheral speed 700–2000 meters/min.) pressure vessels. Carrying a fragile fiber web through such a complicated installation without breaking the same and as required by quality standards is one of the most demanding challenges in paper making. The dryer section also sets strict requirements for the building and subconstructions. Other factors adding to complexity include the passage of a paper web, drive, machine ventilation, pocket ventilation, steam and condensate system, dryer felts, etc.

The "Yankee" cylinder is used for the manufacture of one side glazed (MG-) papers as well as cardboard and creped papers (tissue and industrial crepes). It is a highly massive and demanding body of casting, having a diameter of 3–6 meters, a cylinder length of 3–6 meters, and a weight of 50–100 tons with accessories. Heretofore, there has been no viable, more preferred option available.

OBJECTS AND SUMMARY OF THE INVENTION

An object of the invented apparatus is to substantially simplify and improve the drying of a paper web.

The invention is characterized in that the cylinder interior is fitted with elements for the injection of a hot heat-transfer fluid against the inner surface of the cylinder for heating the surface, as well as elements for discharging the spent fluid from the cylinder interior, said cylinder being tight or sealed for eliminating fluid leaks.

In a preferred embodiment, the cylinder is provided with a dual-jacket, including an outer jacket against whose outer surface the web to be dried is laid, and the heat-transfer fluid injection elements and discharge elements being positioned between said jacket surfaces.

In order to produce a preferred heating effect, the injection elements can be directed towards an upper segment of the inner surface of the outer cylinder jacket and the discharge elements can be respectively mounted on a lower segment within an intermediate space between the jackets.

The dryer cylinder rotates around a large-diameter stationary core cylinder and it is sealed e.g. with an anti-leak packing. The core cylinder may have a diameter which is e.g. 0.5–1.5 meters less than that of the dryer cylinder.

In a preferred embodiment, the heating elements; and discharge elements are stationary relative to the cylinder.

The drying cylinder can be at least partially covered by a drying hood, which is provided with an inlet and outlet duct for a drying medium, such as air, water vapor and/or an inert gas. In view of recovering waste heat, the inlet duct for a drying medium can preferably be in a heat-exchange contact with an inlet and/or outlet duct for a heat-transfer fluid, in addition to which the outlet duct for a drying medium can be fitted with a heat exchanger (13) for recovering its waste heat, e.g. in view of heating water or air.

The present invention relates also to a method for drying fiber webs, such as webs of natural fiber, synthetic fiber and the like, by means of a rotating, substantially horizontal cylinder, the fiber web to be dried being laid against the outer surface thereof. An essential feature in the method is that the inner cylinder surface is injected or sprayed with a hot heat-transfer fluid and that the spent heat-transfer fluid is dis-charged from the cylinder interior. This provides an effective heat exchange between the heat-transfer fluid and the cylinder surface to be heated. Temperature of the drying cylinder surface can be raised even to exceed 300° C., which is not possible by means of conventional steam-heated equipment.

The cylinder rotates on an assembly of supporting wheels and the cylinder is operated by means of a gear, a pinion, or a like drive wheel or wheel assembly in cooperation with the perimeter. The cylinder rotates around a fixedly mounted core cylinder. The core cylinder has a diameter of e.g. 1–5 meters and, thus, between the same and the rotating cylinder surface remains a heating duct, the distance between the surfaces being e.g. 0.3–1.0 meters. Hence, the cylinder core or center does not rotate and, thus, in the cylinder heating duct, it is possible to extend therethrough the supply and discharge pipes and the like included in a heating system. The heating elements are immobile relative to the rotating cylinder.

The core cylinder is mounted fixedly and propped against a frame structure standing on base tracks, such that the core cylinder remains as an open space for the adjustment and maintenance of heating equipment. The core cylinder is well insulated for eliminating heat losses. There is a passage through the core cylinder even as the machine is running. A support and drive system for the dryer cylinder has been described in Patent application No. 956213. In addition, in view of stabilizing its rotation, the cylinder can be equipped with external roller assemblies, which are mounted upon the core cylinder.

To improve the stability of the core cylinder, the end frame structures can be connected by means of beam assemblies bracing the inner surface of the core cylinder. In order to compensate for thermal expansion of the core cylinder, one of the end rings of the cylinder is mounted on the frame structure by means of a "slip joint".

The heat-transfer fluid may comprise a variety of liquids, such as water, oil, or other appropriate fluids having a high thermal capacity. Preferred is a heat-transfer oil. All that is needed for heating a cylinder surface with oil is an oil heating boiler with its accessories, supply ducts with nozzles therefor and, for recirculation, a conventional syphon generally used for condensate removal. Depending on its quality, oil is capable of providing a temperature of 300–500° C., i.e. higher than conventional pressure steam.

The application of a large-diameter (1–5 meters) core cylinder of this invention offers a multitude of novel features, solutions, and benefits.

The horizontal cylinder rotates upon an assembly of supporting wheels. Optionally, the drive means may comprise a chain or a gearing, whereby a gearing circles the periphery, and a motor-driven gear associated therewith. Of course, other per se known drive means can also be used, the essential feature being, however, that the drive is effected by way of the cylinder periphery. A peripheral drive offers more accurate speed control and lower energy consumption than a central drive.

The cylinders are principally made of steel plates, having a possible thickness of 5–30 mm, the sheet being rolled and welded into a cylinder which can be turned, dressed and finished according to intended use. The cylinder (i.e., annular) heating chamber is provided with fluid nozzles and/or other accessories by bringing the same in by way of the core cylinder and through its shell. Between the end plate of the cylinder and the surface of the core cylinder is fitted a packing for eliminating the leak of a heat-transfer fluid. The rotating cylinder is furnished with internal reinforcement rings (e.g. 1.5–2.0 meters apart) for retaining the cylindrical shape.

BRIEF DESCRIPTION OF THE DRAWINGS

The invention will now be described in more detail with reference made to the accompanying drawings, in which.

DETAILED DESCRIPTION OF THE PREFERRED EMBODIMENT

Figure 1:
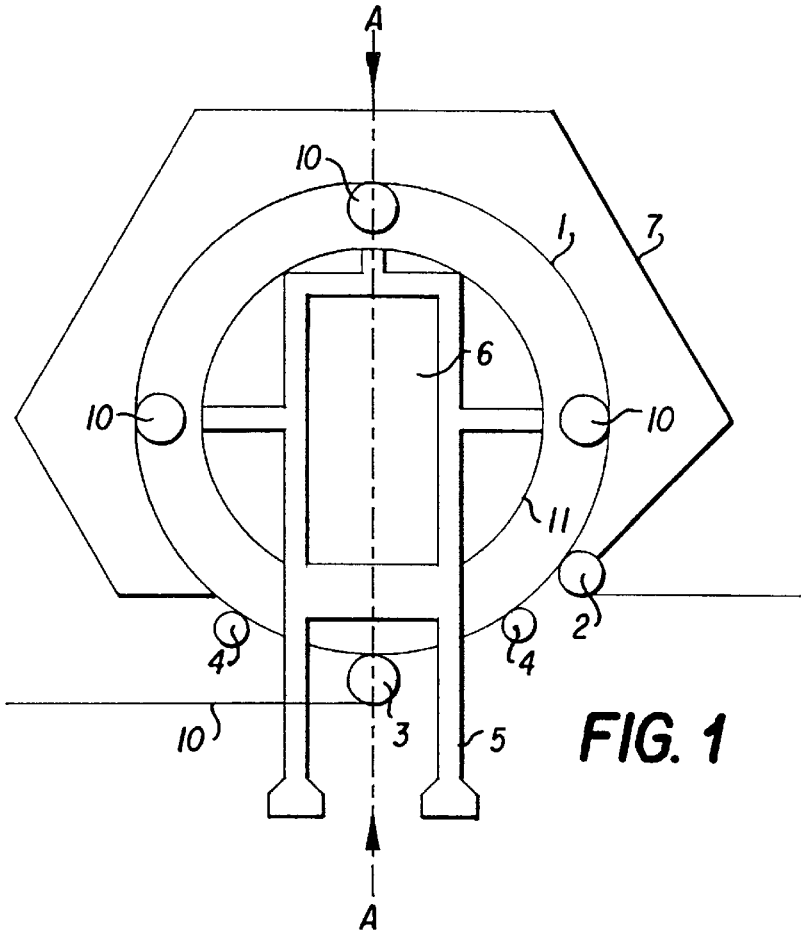
FIG. 1 depicts a dryer cylinder apparatus of the invention.
Figure 2:
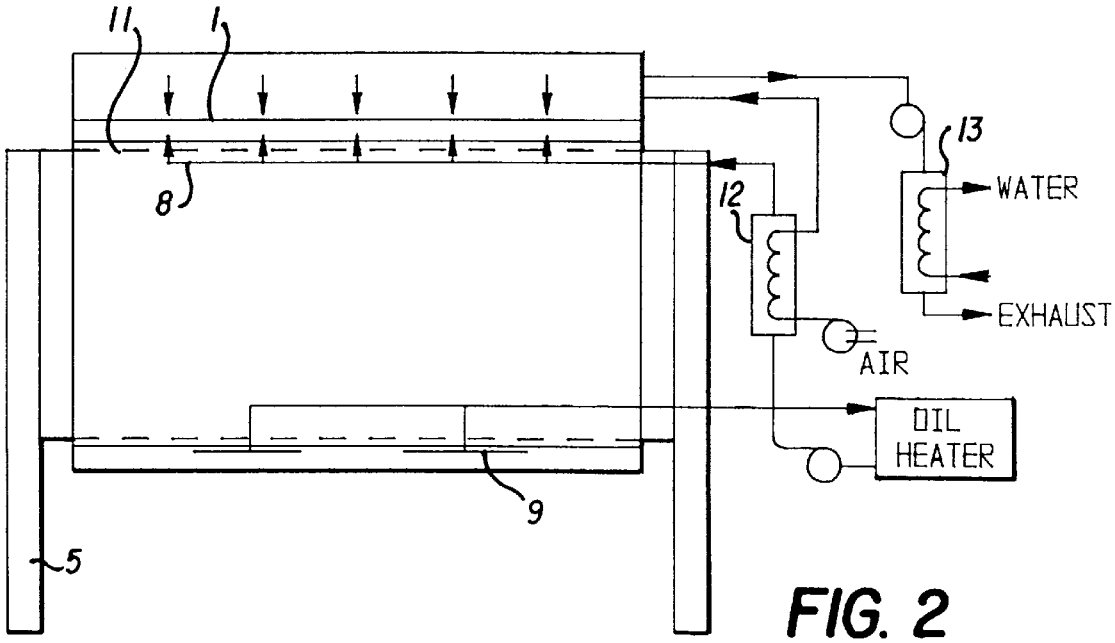
FIG. 2 shows a cross-section of FIG. 1 along a line A—A.

FIGS. 1 and 2 illustrate a horizontal metal cylinder 1 of the invention (FIG. 2 shows a cross-section of the apparatus shown in FIG. 1 along a sectional line A—A). The cylinder 1 is mounted on a support frame 5. A drying hood 7 (high velocity hood) encloses partially the cylinder 1, the bottom portion remaining outside the covering hood 7 for delivering and discharging a fiber web. The drying hood can also be mounted along the sides or below the dryer cylinder.

The cylinder rests on top of supporting rolls 4, some of which are provided with a drive and which, upon rotating against the periphery of the cylinder 1, rotate the cylinder. There may be a number of such drive wheels 4. A fiber web 10 to be dried is delivered onto the cylinder 1 along a supply line which is guided by feed rolls as well as by a press roll 3 pressing against the cylinder periphery. The fiber web can be brought onto a drying surface e.g. by means of a so-called dryer felt. The fiber web can also be carried through drying between a felt and the cylinder surface. The support and drive wheels 4 are located on the side periphery of the cylinder so as not to touch the actual drying surface of the cylinder 1 and, thus, lie outside the working range of the press roll.

The fiber web 10 to be dried is guided onto the surface of the cylinder 1 to be carried thereby almost through a full revolution, whereafter it is removed e.g. by way of a guide roll 2 from the drum surface and the fiber web 10 is possibly guided further to a next dryer apparatus or a winding machine or the like.

The cylinder 1 is heated from inside by means of heating elements 8 included in the interior thereof. The dryer cylinder 1 is heated from inside by means of hot-oil injection but, of course, a useful heating fluid may be any one of a number of high-temperature boiling-point heating fluids. The necessary heating elements are brought inside the dryer by way of a so-called core duct. The core duct is a cylinder, having a diameter of 1–5 meters, and it is fixedly propped against frame structures mounted on base tracks.

The cylinder can be made of steel plate with a thickness of 5–30 mm. The sheet is rolled into a cylinder and the edges are welded. The dryer cylinder can further be turned, dressed and finished according to intended use. Thus, the joints can be totally eliminated and the drying result is faultless.

The size of the dryer cylinder 1 is of course subject to intended use and it can be for example 1.5–7 meters in diameter and 2–10 meters in length. In order to retain its shape, the cylinder is provided with an end plate as well as with reinforcement rings at appropriate spacings. The end plates may have a height of 0.3–1.0 meters and they extend to the proximity (0.1–1.0 cm) of the jacket of the supporting cylinder.

The dryer cylinder 1 operates at normal atmospheric pressure and rotates upon supporting rolls and it is rotated by means of the drive wheel 4 running along its periphery or by means of a like drive means. Thus, the heating equipment can be mounted inside the cylinder in a stationary manner.

For example, when drying newsprint or cardboard, it is possible to place several, in an exemplary case 4–6, dryer units of the invention successively in such a geometry that results in a closed run for the fiber web.

In the embodiment shown in FIGS. 1 and 2, the cylinder comprises a dual-jacket cylinder, the space between an outer jacket 1 and an inner jacket 11 accommodating heating-oil injecting nozzles 8. There is a relatively short distance between the cylinders, resulting in a small heating chamber.

The oil is heated to a temperature of 300–500° C. with prior known technology and it is pumped through an intake manifold internally of the core cylinder to both transversely and longitudinally properly spaced heating-oil injection nozzles 8 for injecting the same against the inner wall of the dryer cylinder. The nozzles 8 can be adjusted and maintained from inside the core cylinder even as the machine is running. An adjustment of the injection nozzles nozzle 8 results in an adjustment of temperature profile. Since the heating chamber remaining between the cylinders 1, 11 is limited and the core cylinder is effectively heat insulated, the heat loss in a dryer of the invention is minimized. The dryer cylinder 1 is subjected to the action of a centrifugal force produced by rotating motion so as to build a uniform layer of hot oil on the inner cylinder surface. The thickness of such a layer is regulated by means of a siphon 9, included in the bottom portion of the cylinder and normally used also in draining.

The high temperature of oil and its high transfer of heat to metal render the solution of the invention more effective than conventional high-pressure steam heating.

FIG. 2 refers to oil heating. A supply duct 12 is used for pumping hot oil inside the cylinder 1, which is injected by way of the nozzle 8 onto the inner surface of the dryer cylinder in the top segment thereof. The oil trickled to the bottom portion of the cylinder 1 is discharged e.g. by means of the prior known syphon 9 to a heating device, wherefrom it is delivered in a heated condition and e.g. through a heat exchanger 12, wherein drying air is heated, to a drying hood 7 and onto the outer surface of a fiber web lying on the outer surface of the cylinder 1. The moist hot air emerging from the drying hood 7 is delivered to a second heat exchanger 13, wherein the water vapor condenses and at the same time the heat is transferred to water for further exploitation thereof in so-called pulp processing etc.

Figure 3:
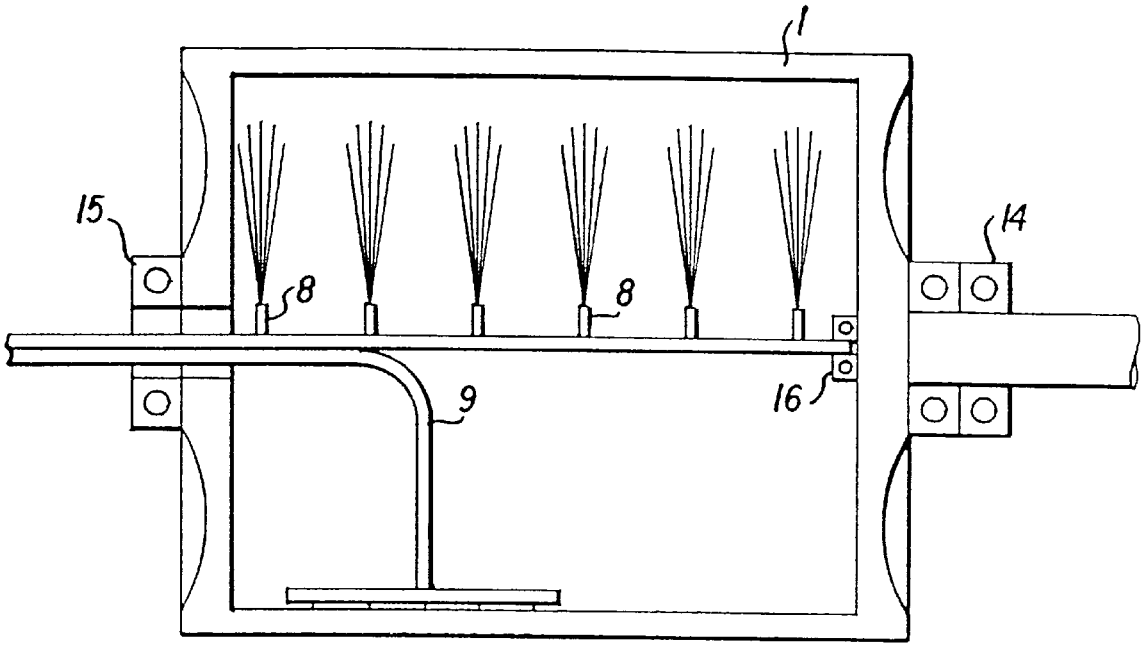
FIG. 3 shows an embodiment of the invention.

One significant benefit of the invention is that the apparatus and method can be applied and used very advantageously in already existing installations. FIG. 3 depicts a conventional cast-iron dryer cylinder 1 rotating upon end bearings 15, originally intended to be heated by pressure steam. Inside such a tight cylinder is extended a heat-transfer fluid supply pipe 8 with its nozzles. This supply pipe is journalled at one end to the back wall of the cylinder 1. In addition, into the cylinder is extended a heat-transfer fluid discharge pipe or siphon 9, provided with a syphon for sucking out the fluid collected an the bottom of the cylinder and for returning it to the fluid heater for its subsequent recirculation as a hot heat-transfer fluid into the cylinder. According to the invention, it is possible to give up the use of pressure in a dryer cylinder and to improve the heating effect by simple means and at very low costs.

The press roll 3 pressing a fiber web against the surface of the dryer cylinder 1 applies a high external pressure to the cylinder 1. In order to offset this, the interior of the cylinder 1 can be provided with a counter-roll (not shown) in alignment with the press roll 3 and adjacent to the siphon device 9. The counter-roll has its surface preferably recessed to form e.g. 10–50 mm deep and 10–50 mm wide grooves along the roll length. By virtue of the grooves, the heat-transfer fluid does not build in front of the counter-roll a layer of material affecting rotation of the cylinders and transfer of heat as the counter-roll rotates inside the cylinder. The counter-roll dimensioning is selected according to the dryer cylinder and its design, a typical length is 3–8 m and the diameter is less than the inner diameter of the dryer cylinder. In addition to and as an alternative for an internal counter-roll, it is possible to employ an external counter-roll which is located on the cylinder surface opposite to the press roll 3. Positioned like this, the counter-roll also presses the web 10 against the cylinder 1.

The apparatus and method of the invention are applicable to the drying of all types of fiber webs, such as paper, cardboard, pulp, synthetic fiber and the like webs. The method is also highly suitable for drying a coating and yields a high-quality finish.

What is claimed is:

1. An apparatus for drying a fiber web, the apparatus comprising:

a substantially horizontal, dual-jacket structure comprising an outer rotatable cylinder and a stationary, non-rotating core disposed within the rotatable cylinder, wherein the core comprises an inner jacket and the rotatable cylinder comprises an outer jacket;

two end walls between the inner jacket and the outer jacket, comprising an anti-leakage packing, whereby a space between an inner surface of the outer jacket and an outer surface of the inner jacket comprises a sealed heating chamber;

wherein the non-rotating core comprises an open space for adjustment and maintenance;

an assembly of support wheels externally supporting the rotatable cylinder, the wheels including at least one driving wheel rotating the rotatable cylinder; and fluid injection elements directing a heat transfer medium onto an inner wall of the outer jacket for heating an outer surface of the rotatable cylinder, against which the web is to be dried, and discharge elements in the space between the outer and inner surfaces of said jacket for discharging spent heat transfer media from the interior of said cylinder.

2. The apparatus as set forth in claim 1, wherein the open space comprises a passage running therethrough.

3. The apparatus as set forth in claim 1, wherein the non-rotating core is insulated.

4. The apparatus as set forth in claim 1, wherein the discharge elements extending through said end walls.

5. The apparatus as set forth in claim 1, wherein the fluid injection elements comprise outlets directed towards an upper segment of the inner surface of the outer jacket of said cylinder.

6. The apparatus as set forth in claim 1, wherein the discharge elements are mounted on a lower segment in the space between the outer and inner jackets of said jacket.

7. The apparatus as set forth in claim 1, wherein the fluid injection elements for the heat transfer media comprise outlets directed towards an upper segment of the inner surface of the outer jacket of said cylinder and the discharge elements are mounted on a lower segment in the space between the outer and inner jackets of said jacket.

8. The apparatus as set forth in claim 1, wherein the non-rotating core is cylindrical and has a diameter 0.5 m to 1.5 m less than a diameter of said cylinder.

9. The apparatus as set forth in claim 1, wherein said cylinder comprises rolled and welded steel plate which is turned and dressed.

10. The apparatus as set forth in claim 1, wherein said cylinder is cast, turned, and dressed.

11. The apparatus as set forth in claim 1, comprising a drying hood comprising an inlet duct for an additional drying medium selected from air, steam, an inert gas and mixtures thereof.

* * * * *